US007886368B2

(12) United States Patent
Hood

(10) Patent No.: US 7,886,368 B2
(45) Date of Patent: Feb. 15, 2011

(54) GARMENT BACKPACK

(76) Inventor: Tony Hood, 5524 Washington Rd., #201, Kenosha, WI (US) 53144

( * ) Notice: Subject to any disclaimer, the term of this patent is extended or adjusted under 35 U.S.C. 154(b) by 0 days.

(21) Appl. No.: 11/758,501

(22) Filed: Jun. 5, 2007

(65) Prior Publication Data

US 2007/0226871 A1 Oct. 4, 2007

Related U.S. Application Data

(63) Continuation-in-part of application No. PCT/US2005/043987, filed on Dec. 6, 2005, which is a continuation-in-part of application No. 11/005,526, filed on Dec. 6, 2004.

(30) Foreign Application Priority Data

Dec. 6, 2005 (US) ..... PCT/US05/43987

(51) Int. Cl.
*A41D 1/04* (2006.01)

(52) U.S. Cl. ..... 2/102; 2/247

(58) Field of Classification Search ..... 2/102, 2/93, 94, 85, 108, 69, 46, 2.5, 247, 250–253
See application file for complete search history.

(56) References Cited

U.S. PATENT DOCUMENTS

| | | | | | |
|---|---|---|---|---|---|
| 725,903 | A | | 4/1903 | Wilcomb | |
| 4,241,459 | A | * | 12/1980 | Quayle | 2/102 |
| 4,382,302 | A | * | 5/1983 | Watson | 2/102 |
| 4,602,387 | A | | 7/1986 | Zakrzewski | |
| 4,658,442 | A | * | 4/1987 | Tomlinson et al. | 2/94 |
| 4,669,127 | A | | 6/1987 | Swanson | |
| 4,791,681 | A | * | 12/1988 | Dean | 2/106 |
| 5,002,270 | A | | 3/1991 | Shine | |
| 5,014,359 | A | | 5/1991 | Hanson | |
| 5,075,900 | A | * | 12/1991 | Chittenden | 2/94 |
| 5,526,535 | A | | 6/1996 | Dobrzenski | |
| 5,634,579 | A | | 6/1997 | Baclawski | 224/637 |
| 5,639,005 | A | | 6/1997 | Chouinard | 224/580 |
| 5,699,560 | A | | 12/1997 | Greenburg | 2/94 |
| 5,909,802 | A | | 6/1999 | Puco et al. | 2/102 |
| 5,913,409 | A | | 6/1999 | Test | 2/102 |
| 6,105,170 | A | | 8/2000 | Lisciandro et al. | |

(Continued)

FOREIGN PATENT DOCUMENTS

CA 2059520 7/1993

(Continued)

OTHER PUBLICATIONS

Supplementary European Search Report for related application No. EP05853024.

(Continued)

*Primary Examiner*—Tejash Patel
(74) *Attorney, Agent, or Firm*—Gregory J. Leighton; Neal, Gerber & Eisenberg LLP

(57) ABSTRACT

A garment apparatus adapted and configured to have the functionality of a backpack that includes at least one pocket fixedly attached to each of an anterior portion and a posterior portion. The at least one pocket on the posterior portion covers a surface area of the posterior portion in an amount of about one percent up to fifty percent of the surface area.

16 Claims, 3 Drawing Sheets

U.S. PATENT DOCUMENTS

| | | | | |
|---|---|---|---|---|
| 6,131,199 | A | 10/2000 | Bugel et al. | |
| 6,209,135 | B1 * | 4/2001 | Irvin | 2/102 |
| 6,286,146 | B1 * | 9/2001 | Rocker | 2/94 |
| 6,324,697 | B1 | 12/2001 | Shofner | 2/102 |
| 6,336,222 | B1 | 1/2002 | Ware | 2/94 |
| 6,397,392 | B1 | 6/2002 | Wooley et al. | 2/102 |
| 7,010,811 | B1 | 3/2006 | Park | 2/2.5 |
| 2002/0189000 | A1 | 12/2002 | Jordan | |
| 2004/0040493 | A1 | 3/2004 | Vineis et al. | |
| 2004/0099130 | A1 | 5/2004 | Roberts et al. | |
| 2004/0147377 | A1 | 7/2004 | Gibson-Horn | |
| 2005/0052281 | A1 | 3/2005 | Bann | |
| 2005/0246094 | A1 | 11/2005 | Moscatiello | |
| 2006/0049946 | A1 | 3/2006 | Sullivan et al. | |
| 2006/0082457 | A1 | 4/2006 | Artem et al. | |

FOREIGN PATENT DOCUMENTS

| | | |
|---|---|---|
| EP | 1 402 799 | 3/2004 |
| FR | 2 648 323 | 12/1990 |
| FR | 2802777 | 6/2001 |
| GB | 229968 | 3/1925 |
| RU | 211887 | 9/1998 |
| WO | WO 2006/062919 | 6/2006 |

OTHER PUBLICATIONS

Written Opinion of the International Searching Authority mailed Mar. 6, 2007 for PCT Application PCT/US05/43987.

Office Action mailed Feb. 8, 2007 for U.S. Appl. No. 11/005,526.

International Search Report mailed Jul. 7, 2008 for PCT Application PCT/US05/43987.

Office Action dated Nov. 11, 2008 for related Chinese Patent Application 200580041741.3.

Office Action dated May 22, 2009 for related Chinese Patent Application 200580041741.3.

Office Action dated Oct. 14, 2009 for related Russian Patent Application 2007121144.

Office Action for related Chinese Patent Application 2005800417413.

Office Communication dated Jun. 4, 2010 for corresponding Australian Patent Application No. 2005314273.

Office Action dated Jul. 5, 2010 for corresponding European Patent Application No. 05853024.7.

* cited by examiner

GARMENT BACKPACK

CROSS-REFERENCE TO RELATED APPLICATIONS

This application is a continuation-in-part of International Application No. PCT/US2005/043987, filed on Dec. 6, 2005, which is a continuation-in-part of U.S. application Ser. No. 11/005,526, filed Dec. 6, 2004, each of which is incorporated herein by express reference thereto in its entirety for all purposes.

FIELD OF THE INVENTION

The present invention relates to backpacks, including, but not limited to, backpacks used to carry books, school supplies, and the like.

BACKGROUND OF THE INVENTION

Backpacks are known and commonly used. Typical backpacks, however, are supported upon a user through use of shoulder straps and belts. This results in back strain and muscle fatigue.

Also typical to currently available backpacks is an arrangement whereby items carried within a backpack are generally carried posterior to the user, making for a large bulge extending posteriorly from the user. Backpacks, as their generic name implies, allow respective users to carry items on their backs, and do not allow for distribution of weight and cargo toward a user's anterior side. This results in uneven weight distribution and uncomfortable portage of items within a backpack.

SUMMARY OF THE INVENTION

The present invention is directed to a garment apparatus for use as a backpack. A preferred embodiment of the garment apparatus includes an anterior portion that has an interior side and an exterior side, a surface area, and being divided into a right half and a left half, each half having a top edge, a medial edge, a bottom edge, and a distal edge. The anterior portion also includes a releasable fastener to releasably fasten the medial edges of the right and left halves, and at least one pocket fixedly attached thereto. In an alternative embodiment, the right and left halves of the anterior portion are made of a unitary construction having an interior side, an exterior side, a surface area, a top edge having a left side and a right side, a bottom edge, at least two side edges, and at least one pocket fixedly attached thereto, the garment apparatus being worn by pulling it over the head.

The garment apparatus also includes a posterior portion that has an interior side, an exterior side, a surface area, a right edge, a left edge, a top edge having a right and left side, and a bottom edge. The posterior portion includes at least one pocket fixedly attached thereto that covers about 1 percent up to 50 percent of the surface area of the posterior portion, and which is disposed predominantly adjacent an upper half of the posterior portion. In one preferred embodiment, the posterior portion includes a second pocket fixedly attached thereto that covers about 1 percent up to 50 percent of the surface area of the posterior portion, and which is disposed predominantly adjacent a lower half of the posterior portion.

The anterior and posterior portions are joined such that the top edge of the right half of the anterior portion is joined to the right side of the top edge of the posterior portion from a part of the right edge of the posterior portion to the right side of a collar, and the top edge of the left half of the anterior portion is joined to the left side of the top edge of the posterior portion from a part of the left edge of the posterior portion to the left side of the collar, such that an opening or aperture is surrounded by the collar.

Preferably, the garment apparatus further includes at least one resilient section, the resilient section having an anterior edge and a posterior edge. The anterior edge is preferably releasably or fixedly joined to the anterior portion and the posterior edge is preferably releasably or fixedly joined to the posterior portion, with the resilient section comprising a flexible and resilient material.

In one embodiment, the anterior portion includes three to four pockets at least one of which is sized and dimensioned to receive and retain a cell phone. Additionally, at least one of the pockets is sized and dimensioned to receive and retain a camera or CD or DVD player. Preferably, at least one of the pockets includes an internal port that defines a passage from the interior of the pocket through to the interior surface of the garment.

Preferably, the garment apparatus further includes a second releasable fastener that is configured and adapted to releasably fasten the left edge of the posterior portion to the distal edge of the left half of the anterior portion, and the second releasable fastener is also preferably configured and adapted to releasably fasten the right edge of the posterior portion to the distal edge of the right half of the anterior portion, or both. The second releasable fastener preferably includes at least one of a snap, button, zipper, hook and loop fastener, adjustable belt portion, or tie.

The garment apparatus preferably further includes at least one shoulder pad attached to the interior side of the anterior and posterior portions proximal to the joined top edges of the posterior and anterior portions, at least one cushioning material in at least one pocket, at least one interior lining associated with the apparatus, or a combination thereof. Also, the garment apparatus preferably further includes a releasable fastener to releasably fasten at least one of the pockets to help retain or transport items residing therein. More preferably, the releasable fastener comprises at least one of a zipper, snap, button, clip, hook and loop fastener, tie, and drawstring.

In one embodiment, the first pocket that is fixedly attached to the posterior portion is located substantially proximal to the top edge of the posterior portion. In another embodiment, a second pocket is fixedly attached to the posterior portion predominantly in the lower half thereof, the second pocket is located substantially proximal to the bottom edge of the posterior portion. In another embodiment, one of the pockets fixedly attached to the anterior portion is a cell phone pocket configured and dimensioned so as to substantially conform to a cell phone when disposed therein. Preferably, the total pocket volume available on the anterior portion is sufficient to counterbalance the total pocket volume available on the posterior portion.

Another preferred embodiment of the garment apparatus includes an anterior portion having an interior side and an exterior side, a surface area, a top edge having a right side and a left side, a bottom edge, and at least two side edges and at least one pocket fixedly attached thereto, and a posterior portion having an interior side, an exterior side, a surface area, a right edge, a left edge, a top edge having a right and left side, and a bottom edge, and having at least one pocket fixedly attached thereto. The anterior and posterior portions are associated such that the right and left sides of the top edge of the anterior portion is connected adjacent the right and left sides of the top edge of the posterior portion to leave an opening therebetween. The at least one pocket includes an internal port that provides a closeable opening from an inside portion of the pocket to the interior side of the garment apparatus.

In one embodiment, the pocket fixedly attached to the posterior portion is adapted and configured to define a pouch opening or slot passage for releaseably holding at least one item therein or placing at least one item therethrough. In a preferred embodiment, the pouch opening is configured for storing at least one item between the pocket and the posterior portion. In yet another preferred embodiment, the pocket is attached to the posterior portion along two sides so as to leave at least a portion of each of the remaining two sides open to define the slot passage between the pocket and the posterior portion for placing one or more items therethrough.

In yet another embodiment, the garment apparatus further includes an electronic control unit disposed on, or integrally associated within, the exterior surface of the garment apparatus. In a preferred embodiment, the electronic control unit is configured and adapted to be operatively associated with a hardwired and/or wireless electronic device contained within one of the pockets of the garment apparatus. In a further embodiment, the garment apparatus may further include a personal hydration system that includes a container fixedly or releasably attached to the garment apparatus or a portion thereof, or a pocket for releasably holding a container, which container is associated with a dispensing member and which is adapted to hold a beverage consumable by the wearer. In yet a further embodiment, the garment apparatus further includes a fastening device configured and adapted to removeably fasten the pockets to the garment apparatus.

The present invention thus discloses a novel apparatus that addresses many of the deficiencies of traditional backpacks.

BRIEF DESCRIPTION OF THE DRAWINGS

Further features and advantages of the invention can be ascertained from the following detailed description that is provided in connection with the drawing(s) described below.

DETAILED DESCRIPTION OF THE PREFERRED EMBODIMENTS

Figure 1:
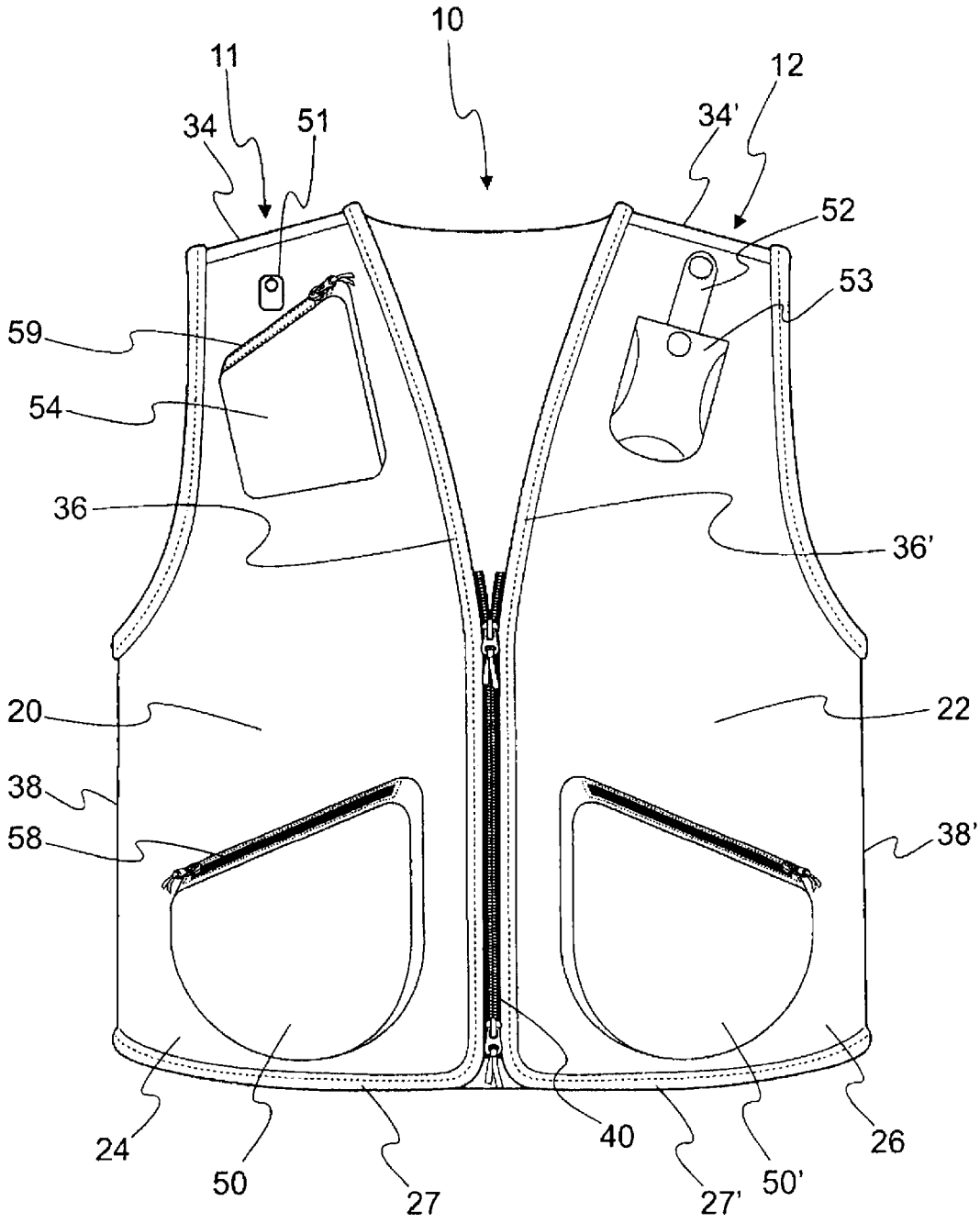
FIG. 1 illustrates a preferred embodiment of the apparatus from an anterior view.

A more ergonomic backpack has now been discovered in that the pockets are distributed more closely over the center of gravity of a wearer, or user, compared to a traditional backpack by being disposed on a garment apparatus. This advantageously permits a forward shift of weight compared to a conventional backpack. In a preferred embodiment shown in FIGS. 1-3, the apparatus 10 includes a garment that includes an anterior portion 20 and a posterior portion 30. Referring initially to FIG. 1, the anterior portion 20 has an interior side or surface (not shown) and an exterior side or surface 22 having a surface area. The anterior portion 20 is divided into a right half 24 and a left half 26, each half having, respectively, a top edge 34,34', a medial edge 36,36', a distal edge 38, 38', and a bottom edge 27,27'. As used herein, the terms "right" and "left" are used with references to the right and left sides of the user's body while wearing the garment apparatus.

Figure 3:
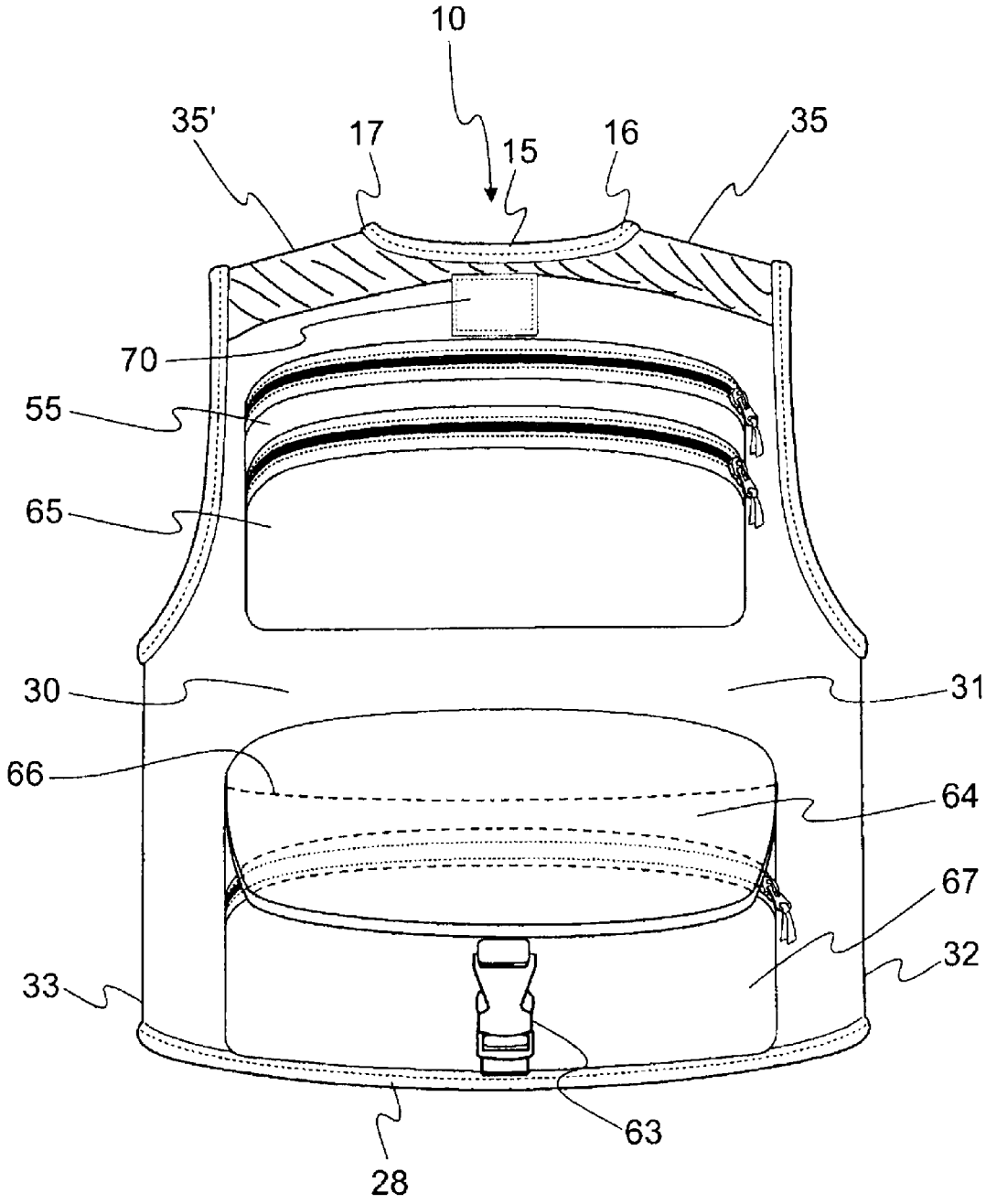
FIG. 3 illustrates a preferred embodiment of the apparatus from a posterior view.

Referring to FIG. 3, the posterior portion 30 has an interior side or surface (not shown), an exterior side or surface 31 having a surface area, a right edge 32, a left edge 33, a top edge having a right side 35 and a left side 35', a bottom edge 28, and a collar 15 having a right side 16 and a left side 17.

The anterior portion 20 and the posterior portion 30 are joined such that the top edge 34 of the right half 24 of the anterior portion 20 is joined, preferably fixedly, along a part of the right side of top edge 35 of the posterior portion 30, preferably substantially or entirely from the right edge 32 of the posterior portion 30 to the right side 16 of the collar 15. The anterior portion 20 and the posterior portion 30 are also joined, preferably fixedly, such that the top edge 34' of the left half 26 of the anterior portion 20 is joined along a part of the left side of the top edge 35' of the posterior portion 30, preferably substantially or entirely from the left edge 33 of the posterior portion 30 to the left side 17 of the collar 15.

The respective right and left top attachment areas of the anterior portion 20 and the posterior portion 30 define right and left shoulder portions 11,12 that are preferably configured to rest on the shoulders of the user when the apparatus is worn. In one embodiment, the right and left shoulder portions 11,12 include additional padding preferably sewn therein. Preferably, the padding is attached to the interior surface of both the anterior portion 20 and posterior portion 30 proximal to where the top edges 35,35' of the posterior portion 30 are joined to the top edges 34,34' of an anterior portion 20. In this position, the padding can be located over a user's shoulder to help cushion any load imparted thereon by the weight of cargo within any pockets on the garment apparatus. Additional cushioning material can also be disposed adjacent or around any or all of the pockets disposed on the anterior or posterior portions. Additional cushioning material can disposed within a portion of any or all of the pockets, e.g., lining the interior of a pocket. The portion can be a part or the entire pocket(s), to help protect and cushion the contents contained therein. In other embodiments, an impact-deflecting material having sufficient area and thickness of cushioning, padding, or protective material, including but not limited to, one or more foams, memory foams, plastics, or any combination thereof, can be disposed within the anterior and/or posterior portion of the garment to increase user protection, for example, when operating a motorcycle or riding a bicycle or skateboard. In this embodiment, the impact-deflecting material will preferably decrease or eliminate injury to any covered portion of a wearer's torso. The cushioning material could also or alternatively be an insulating material to minimize or prevent the transfer of heat, electricity, or moisture away from or into a pocket. Any suitable material with the desired characteristics can be included or used alone or in combination with any other suitable material for the cushioning material or the interior lining of the apparatus.

In another embodiment, the garment apparatus can include an interior lining, preferably made of a compatible or a similar material as the cushioning material, even though it can provide less of a cushioning effect than the cushioning material simply by, e.g., being a thinner layer or a material with fewer layers. The interior lining is preferably removably attachable to one or more interior surfaces of the garment apparatus. Such a lining can advantageously provide one or more of the following: added warmth to the user, wicking moisture away from the user, or protecting the user from any sharp or jutting edges of the contents contained in the pockets, or any combination of these benefits. For example, the interior lining can be attached via a plurality of buttons or other fastener(s) spaced strategically throughout the interior of the garment apparatus, such as one at each sleeve, at least one fastener at the collar, and at least one fastener disposed on the lower half preferably substantially proximal toward the lower edge of the apparatus.

Figure 2:
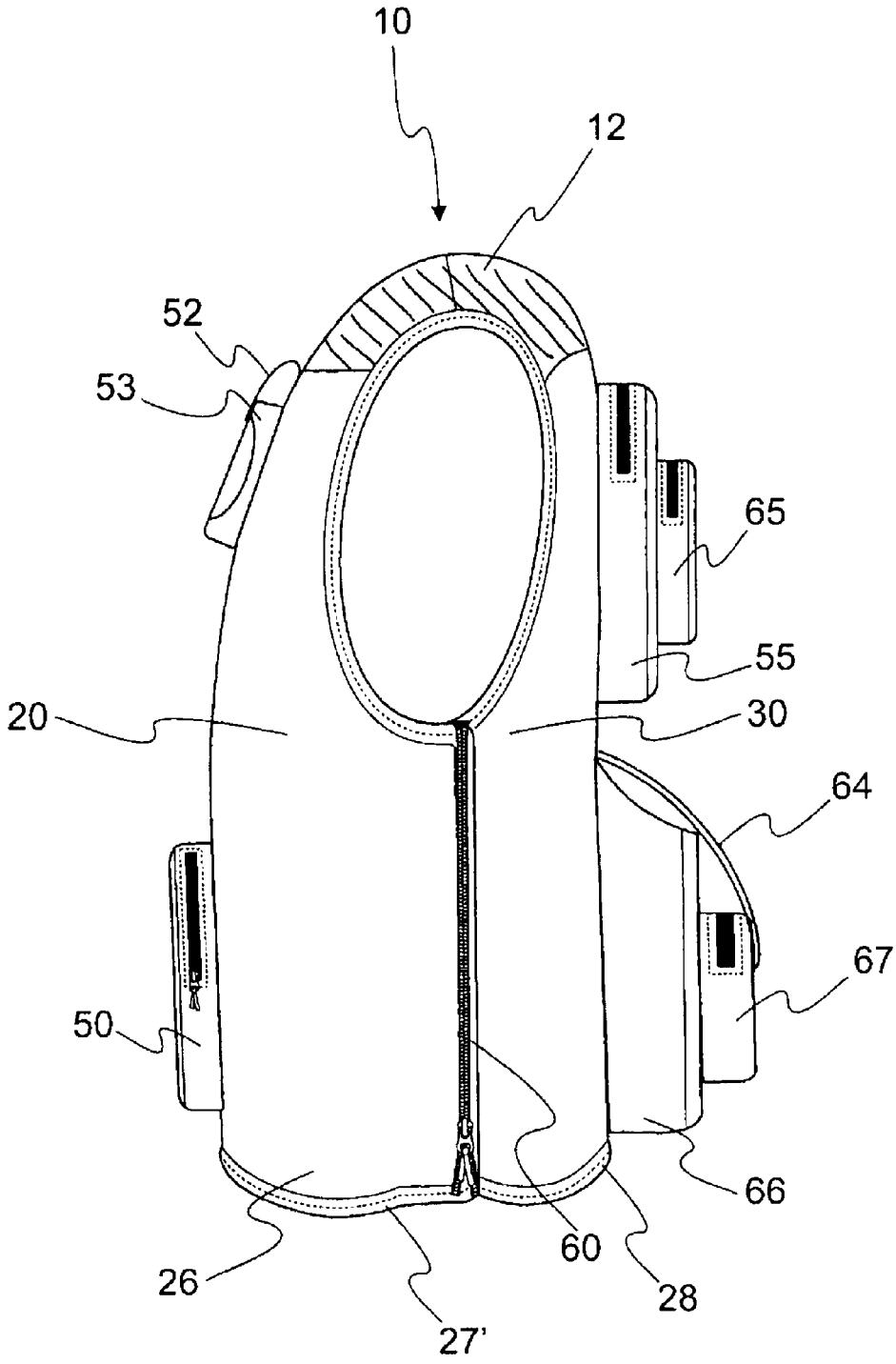
FIG. 2 illustrates a preferred embodiment of the apparatus from a lateral view.

The anterior portion 20 and the posterior portion 30 are also typically joined such that the distal edge 38 of the right side 24 of the anterior portion 20 is joined or otherwise attached to a part of the right edge 32 of the posterior portion. Similarly, the distal edge 38' of the left side 26 of the anterior portion 20 is joined or otherwise attached to a part of the left side 33 of the posterior portion 30. In one embodiment, these parts can be joined by one or more side attachments, which join the anterior and posterior portions laterally. Preferably, each side attachment is affixed, preferably by stitching or other permanent joining material, to provide lateral support to the user when wearing the garment apparatus. The side attachment can be a separate portion of material from the anterior and posterior portions, or simply a zone where the posterior and anterior portions are joined permanently. Alternatively, as shown in FIG. 2, the side attachment 60 can be simply a releasably engageable fastener that is, for example, a zipper; one or more buttons, clips, or snaps; a hook and loop portion; tie; drawstring; or similar releasable fastening mechanism. In one embodiment, the right and left side attachments are both present and include adjustable expansion fasteners, such as adjustable two-way zippers, that allow the user to control the degree of side attachment, and thus readily tailor the size of the apparatus to the user's build. For example, a zipper can be adjusted such that the side attachment is complete, substantially complete, partially complete, or unfastened, thus advantageously allowing the apparatus to be worn over bulkier clothes or a larger user if needed. These fasteners also provide a way for a user to create a snug fit that can be beneficial to both comfort and ergonomical distribution of the weight of cargo within the apparatus.

The anterior portion 20 preferably includes a medial releasable fastening mechanism 40 to releasably fasten the medial edge 36 of the right half 24 to the medial edge 36' of the left half 26. The fastening mechanism can include those noted above, and may be the same or different. Preferably, the releasable fastener 40 is an adjustable zipper, e.g., two-way and with a fabric zipper pull, as shown in FIG. 1. In an alternative embodiment, the right and left halves of the anterior portion are made of a unitary construction such that the garment apparatus can be easily pulled over the user's torso rather than fastening the right and left halves. In such an embodiment, no releasable fastener is included on the apparatus to fasten the two integral halves.

The anterior portion 20 preferably includes at least one pocket fixedly attached to the anterior surface 22. In one embodiment, the pockets are releasably attachable to the exterior surface 22 by a fastening mechanism, such as a zipper, clips, or snaps. Preferably, the anterior portion 20 includes at least one large pocket that covers at least about 10% to 40% of the exterior surface 22 of the anterior portion 20, and more preferably covers at least about 20% to 35% of the exterior surface 22. The large pocket is preferably disposed at the lower portion of the anterior portion 20, and includes a top releasable fastener of the types described above, which may be the same or different, to provide easy and convenient access by the user to the contents therein. The large pocket can have any shape such as rounded, square, rectangular, or asymmetric. Preferably, the large pocket is configured and dimensioned to contain relatively large and bulky items, such as a CD player or stack of CDs, or a camera. The large pocket is also preferably made of a material that is sufficient to protect the contents therein from damage due to external forces, for example, scratching of CDs or damage to a CD player. Preferably, one pocket is included on the left half and one on the right half, each being predominantly on a lower half of the anterior portion. These can each be symmetrical or asymmetrical, and can be mirror images of each other if desired to help balance the weight in a symmetrical fashion regardless of the shape of the pockets. In another preferred embodiment, the anterior portion includes these two pockets, as well as a cell phone pocket described herein, and more preferably, the posterior portion includes at least two pockets and preferably at least three where at least one is disposed predominantly in the upper half of the posterior portion and preferably substantially adjacent to the top edge of the posterior portion.

In one embodiment, the large pocket includes an internal port (or channel) that defines a passage from the interior of the large pocket through to the interior surface of the anterior portion 20. The internal port is preferably reversibly closeable so that it can be closed when not in use, such as by one of the fasteners described herein. The internal port can be adapted and configured to automatically close when it is not being kept open, e.g., from forces being applied to keep it open such as fingers or a wire disposed therethrough. Advantageously, the internal port allows an earphone cord to be threaded therethrough such that the ear phone cord can be connected at one end to a device, such as a CD player, contained in the large pocket while substantially the rest of the cord is disposed between the user's body and the interior surface of the anterior portion 20. The opposite end of the cord can exit the interior of the apparatus 10 at an exit port near the collar 15 for placement adjacent the user's ears, or can exit at another internal port. The use of an exit port allows the user to safely wear the earphones while the CD player is contained within the large pocket, thus preventing or substantially reducing the possibility of entanglement of the earphone cord on external objects contacting the wearer. A second internal port can be used to connect the wire(s) to one or more speakers disposed in another pocket, for example, a mesh pocket, through which music can be played. Thus, generally, one or more internal ports can be used or an internal port and an exit port may be used.

In addition to the optional but preferred internal port that runs from the large pocket through to the interior of the anterior portion, and the exit port near the collar, the garment can also include a channel that houses the cord or other wire therein to prevent them from being tangled or visible. The channel can be, for example, a groove or slot, or a tube that preferably substantially or entirely surrounds any cord disposed therein. For example, the channel may be a flexible plastic material into which a cord can be pressed so that the cord then resides entirely within the channel except at each end of the tube (i.e., an internal port or the exit port) where the cord exits the tube. Preferably, the channel is disposed along the interior surface of the anterior portion from the internal port to the exit port. In other embodiments, the channel can be disposed along the exterior surface of the anterior portion, for example adjacent the front zipper of the garment, with one end of the channel connected to or adjacent the exterior of the large pocket and the other end of the channel adjacent the collar. In this embodiment, the channel, either by itself or in association with other features of the garment, is preferably adapted and configured to completely surround the cord. The channel can also be releaseably attachable to the surface of the anterior portion along the length of one side of the channel, for example using one or more of the fastening mechanisms described above. This can advantageously permit the cord to be easily placed and housed within the channel rather than having to feed the cord through one end of the channel up or down until the cord exits at the other end.

The garment also preferably includes an electronic control unit disposed on, or integrally associated within, the exterior surface of the garment. Preferably, the electronic control unit is positioned in a place that is conveniently located for the user to operate it, such as on the upper part of the exterior surface of the anterior portion 20. The electronic control unit (not shown) is configured and adapted to be associated with a hardwired and/or wireless electronic device that may be contained within one of the pockets of the garment. For example, the electronic control unit may be used to control the power, volume, or selection options of an iPod®, cellular phone, or navigation unit. Advantageously, such a control unit allows the user to easily access and control the device remotely, or at least without removing the device from the pocket in which it is contained. Any suitable frequency or other communication mechanism may be used to communicate between the control panel and the desired electronic device, e.g., Bluetooth® technology. Where the electronic control unit is configured for hardwire association with the device, the control unit preferably includes one or more leads that extend from the control unit to one or more pockets of the garment where a compatible device can be stored. More preferably, the leads are disposed within the material of the anterior and/or posterior portions of the garment, or are otherwise fixedly attached to a surface of the garment, preferably an interior surface, for example using a channel to prevent the leads from being tangled or visible. In one exemplary embodiment, a speaker and microphone combination, e.g., a Bluetooth®-enabled cell phone headset can be detachably joined or integrally formed into an area adjacent the collar of the garment.

In one preferred embodiment, which is shown in FIG. 1, the apparatus 10 includes two asymmetrically configured large pockets 50,50' disposed, respectively, from about 0.25 to 2 inches from the bottom edges 27,27' of the right and left sides 24,26. Each of the large pockets 50,50' preferably has a maximum height of about 7 inches near the medial side and a minimum height of about 4 inches, preferably about 5.5 inches, near the distal side. Each pocket also has a width of about 4 to 7 inches, and a depth from the exterior surface 22 of about 1 to 2.5 inches, preferably 1.25 inches to 2 inches. Each of the large pockets 50,50' includes a top zipper 58 with a fabric zipper pull for securing items therein.

Also as depicted in this preferred embodiment of FIG. 1, the anterior portion 20 also preferably includes two side hand pockets disposed at the lower portion of the anterior portion 20 such that the user can comfortably insert the user's hands therein while the user's arms are in a relaxed position. Preferably, each of the side hand pockets is lined with a water-resistant or water-proof material, for example nylon, to help the user retain warmth to the hands inserted therein. The side hand pockets also preferably include a releasable fastener as described herein, which may be the same or different, to secure contents disposed therein other than hands. In a preferred embodiment, the side pockets are disposed substantially at the position of each large pocket, between the large pocket and the interior surface of the anterior portion 20.

The anterior portion 20 preferably includes at least one small pocket that covers from about 1% to 10% of the exterior surface 22 of the anterior portion 20. Preferably, the small pocket is disposed at the upper portion of the anterior portion 20, near the shoulder portions 11,12, and includes a top or side releasable fastener of the types described herein, although it may be the same or different, to provide easy access by the user to the contents therein. The small pocket can have any shape such as rounded, square, rectangular, or asymmetric, and is preferably configured and dimensioned to contain one or more relatively small items, such as keys, coins, mini-DV tapes, flash sticks or cards, or edibles, e.g., gum, candy, etc.

In the preferred embodiment shown in FIG. 1, the garment apparatus 10 includes a small pocket 54 disposed on the right side 24 of the anterior portion 20 between about 2 to about 3 inches from the top edge 34. The small pocket 54 has an asymmetric configuration, preferably having a maximum height of about 5.5 inches near the medial side and a minimum height of about 2.5 inches near the distal side. The small pocket 54 also has a width of about 1.5 inches to 4 inches, preferably about 2 inches to 3.5 inches, and a depth from the exterior surface 22 of about 1 inches to 2.5 inches, preferably from about 1.25 inches to 2 inches. The small pocket 54 includes a top zipper 59 with a fabric zipper pull for securing items therein.

The anterior portion 20 also preferably includes a cell phone pocket that is sufficiently dimensioned to fit standard cell phone sizes, optionally with their own case. The cell phone pocket in one embodiment preferably covers about 1 to 8%, preferably about 2 to 6%, of the exterior surface 22 of the anterior portion 20. Preferably, the cell phone pocket is made of a flexible material, and is configured and dimensioned to provide a substantially snug fit for containing cell phones of various sizes therein. The cell phone pocket is also preferably disposed at the upper portion of the anterior portion 20 such that the cell phone contained therein is relatively close the user's head to allow the user to easily hear ring tones, and to minimize the need to remove it to answer. An upper cell phone pocket also permits use of shorter cords for any wired earpiece or microphone the user might like to include compared to a traditional pocket down by the waist, at the lower edge of the anterior portion. Additionally, the cell phone pocket preferably includes a top or side releasable fastener as described herein. While the cell phone pocket fastener may be any of the fasteners described herein, preferably it is one or more snaps, or a hook and loop portion, to provide rapid and frequent access by the user to the cell phone therein.

In the preferred embodiment shown in FIG. 1, the apparatus 10 includes a cell phone pocket 53 disposed on the left side 26 of the anterior portion 20 between about 2 to about 3 inches from the top edge 34'. The cell phone pocket 53 includes a hook and loop-secured strap 52 that can be pulled over the top of a cell phone to secure the cell phone within the cell phone pocket 53. The cell phone pocket depicted preferably has a maximum height of about 4.5 inches, a maximum width of about 2.5 inches, and a maximum depth of about 1 inch. In one embodiment (not shown), pockets can be made separately available and dimensioned specifically to fit particular models of cell phone to permit each wearer to customize the garment apparatus to their model cell phone.

The anterior portion 20 can also include a variety of attachment portions disposed on the exterior surface 22 of the anterior portion 20. Such attachment portions can include releasable or non-releasable rings, hooks, straps, loop snaps, or the like to provide rapid access to items such as keys or gloves. In the preferred embodiment shown in FIG. 1, the apparatus 10 includes a fabric snap-secured strap 51 disposed on the upper right side 24 of the anterior portion 20, the strap being about 0.5 inches to 2 inches in length.

The anterior portion 20 also preferably includes at least one interior pocket, and preferably two with one on the right and left sides, disposed in the interior surface of the anterior portion 20. Such interior pocket(s) are preferably configured and dimensioned for containing small items such as a wallet or identification cards, and provide a relatively safer location for these items. Optionally, but preferably, the interior pockets include a top releasable fastener of the types described herein to further secure items and minimize theft.

The posterior portion 30 includes at least one pocket fixedly attached to the exterior surface 31. In one embodiment, the pockets are releasably attachable to the surface 31 by a fastening mechanism, such as a zipper. The posterior portion 30 includes at least one upper back pocket that is predominantly disposed on an upper half thereof, and preferably entirely in the upper half of the posterior portion 30. In a preferred embodiment, the upper back pocket is proximate the shoulder portions 11,12. Preferably, at least one lower back pocket is also disposed predominantly, and preferably entirely, on the lower half of the posterior portion 30. Preferably, the at least one lower back pocket is proximate the bottom edge 28. Multiple top and bottom pockets are preferably staggered with respect to each other, with one being closer to the top or bottom, respectively, than others of the same type. Each of the upper and lower back pockets cover at least about 1% up to 50%, preferably 5% to about 45%, and more preferably 10% to about 40%, of the exterior surface 31 of the posterior portion 30. For example, an upper back pocket can be about 25% to 40% and a lower pocket can be about 15% to 30% of the posterior portion. Preferably, the back pockets include a top releasable fastener of the types described herein. The upper and lower back pockets can be sized and dimensioned to advantageously distribute the total pocket volume of the posterior portion among multiple pockets to minimize or prevent overfilling any one pocket.

Preferably, the upper and lower back pockets have a snug fit such that the contents of each pocket are supported close to the user's body and retained within the pocket to prevent substantial shifting of the weight, thus reducing the carrying strain on the user or overturning of objects that may necessitate transport in a specific direction, e.g., a liquid containing vessel that needs to be carried upright. Preferably, the pockets are made of a resilient material that retains its shape and returns to its shape if modified temporarily to hold cargo therein. The back pockets also preferably include an adjustable fastening mechanism to further aid in securing the contents in the pocket snugly, and preferably to keep portions of the pocket closer to and further from the wearer in contact with the cargo in the pocket. This fastening mechanism preferably retains the cargo substantially proximal, or close, to the user's body as defined by the inner portion of the pocket adjacent the garment apparatus. In one embodiment, for example, the adjustable fastening mechanism includes at least one hook and loop fastener with one end secured to a portion of the outer surface of the pocket and the other end secured to a portion of the outer surface of the posterior member such that the outer surface of the pocket can be pulled and secured close to the posterior member. Various other readily achieved configurations can be implemented by those of ordinary skill in the art in view of the disclosure herein.

The upper and lower back pockets are preferably configured and dimensioned to contain larger items therein, such as files, folders, books, pamphlets, water bottles, and the like. The back pockets can also each include dividers and additional compartments therein to help store or retrieve items within the back pockets in a convenient and organized manner. In another embodiment, one or more back pockets on the posterior portion can be made of a mesh or elastic material, and may be arranged to have a drawstring fastening mechanism for securing items placed therein. For example, such a pocket would be better adapted and configured to carry shaped or 3-dimensional items such as balls or equipment since the pocket material could conform to the shape of the items that can be disposed in the pocket. Preferably, such a pocket could also be removeably detachable from the posterior portion of the garment, or be able to hang therefrom.

Additionally, the total pocket volume available on the anterior portion 20 is preferably sufficient to counterbalance the total pocket volume available on the posterior portion 30 to provide added comfort to the user while wearing the apparatus. For example, pocket volumes that are within about 20 volume percent of each other, preferably within about 10 volume percent of each other, and more preferably within about 5 volume percent are sufficiently counterbalanced. Of course, counterbalancing is not required and will in part depend on the density of cargo a user places in the pockets.

In one embodiment, at least one of the back pockets (on the posterior portion), preferably the lower back pocket, can include an internal port (or channel) that defines a passage from the interior of the back pocket through to the interior surface of the posterior portion. The internal port is preferably reversibly closeable so that it can be closed from either side when not in use, such as by one of the fasteners described herein or a lensing mechanism on the aperture. Advantageously, the internal port allows the user to easily access the contents stored in the back pocket by simply reaching behind to the interior surface of the garment and accessing the pocket contents from the interior surface of the garment rather than from the outside releasable fastener or opening.

The internal port can be an opening that is as wide as the outer aperture that can be disposed on the outer surface of each pocket. In one embodiment, an internal port on at least one pocket can simply be wide enough to permit 1 to 3, preferably 1 to 2, cords or wires to pass therethrough to connect cargo with an item outside the pocket that is in close association with the user of the garment apparatus. For example, a CD player or iPod® could be disposed in the pocket, and a wire or pair of headphone wires can pass from the contained device through the internal port to the inside of the garment apparatus (or in between internal layers thereof) and then up to the wearer's ears for enjoyment without dangling wire(s) to be tangled except between, e.g., the collar of the apparatus and the ears, which is likely to be a few inches at most. Also, a cord can be tied or affixed to an anchor within the pocket, such as cushioning material therein or a cargo item that is larger than the internal port. This cord can pass through the internal port and be connected to, e.g., a valuable piece of jewelry, a hat, or a pair of eyeglasses, to help ensure or even prevent it from accidentally or intentionally being lost or stolen.

In the preferred embodiment shown in FIG. 3, the apparatus 10 includes two upper back pockets 55,65 and two lower back pockets 66,67. The two upper back pockets 55,65 include a large pocket 55 and a small pocket 65, with the small pocket 65 disposed on the outer surface of the large pocket 55. The large pocket 55 has a maximum height of about 10 inches and a maximum depth of about 4 inches, and the small pocket 65 has a maximum height of about 8 inches and a maximum depth of about 2.5 inches. The maximum widths of the large and small pockets 55,65 are both about 12 inches. Preferably, the top of the large pocket 55 is disposed within about 2 inches, preferably from about 0.1 inches to 1 inch, from the shoulder portions 11,12, and the top of the small pocket 65 is disposed within about 2 inches, preferably from about 0.1 inches to 1 inch, from the top of the large pocket 55. The position of the upper back pockets 55,65 on the posterior portion 30 advantageously allows the user to more readily and rapidly access the contents of the pockets over the user's shoulder. Both upper back pockets 55,65 include a top zipper with a fabric zipper pull for securing items therein.

The two lower back pockets 66,67 include a large pocket 66 and a small pocket 67, with the small pocket 67 disposed on the outer surface of the large pocket 66. The large pocket 66 has a maximum height of about 10 inches and a maximum depth of about 4 inches, and the small pocket 67 has a maximum height of about 8.5 inches and a maximum depth of about 1.5 inches. The maximum widths of the large and small pockets 66,67 are both about 14 inches. Preferably, the bottom of the large pocket 66 is disposed about 1 inch from the bottom edge 28 of the posterior portion 30, and the top of the small pocket 67 is disposed about 4 inches from the top of the large pocket 66. The small pocket 67 includes a top zipper with a fabric zipper pull for securing items therein. An exemplary upper pocket may be about 6 inches to 8 inches by 10 inches, while an exemplary lower pocket is about 8 inches to 9 inches by about 12 inches to 16 inches.

The large pocket 66 as shown includes a biased top opening and an optional but preferable flap cover 64 that extends from and covers the top of the large pocket 66. The flap cover 64 also covers the top of the small pocket 67, and is secured to the surface of the small pocket 67 by, e.g., a releasable buckle mechanism 63 or other suitable fastener described herein (not shown). Preferably, the female portion of the buckle mechanism 63 is fixedly attached to the center surface of the small pocket 67, and the male portion of the buckle mechanism 63 is fixedly attached to the center of the lower edge of the cover flap 64. In another embodiment, the cover flap can include multiple buckle mechanisms for securing the cover flap over both the large pocket and the small pocket. Additionally, the large pocket can also include a top zipper or drawstring to provide added security to the items therein.

In another preferred embodiment, some or all of the upper and lower back pockets can be configured to define a slot passage or pouch opening for securely holding items therein or placing items therethrough that are too large to fit in a pocket. For example, in the embodiment shown in FIGS. 2 and 3, the upper back pocket 55 can be attached to the posterior portion 30 along only three sides (e.g., top, left, and bottom) leaving the fourth side (right) open and thus defining a pouch opening for storing items in the area between the pocket 55 and the posterior portion 30. Fastening mechanisms, such as those previously described, can be used to close the opening to secure the contents therein. The pockets may instead be replaced by such slot passage or pouch opening, as well.

In other embodiments, the upper back pocket 55 can be attached to the posterior portion 30 along only two sides (e.g., top and bottom) leaving both sides open to define a slot passage therethrough. Advantageously, the slot passage allows any oversize item(s) such as skateboards, fishing poles, tennis rackets, and bats, which are typically too long to be contained in one of the pockets, to be placed through one end of the slot passage and out the other end, thus allowing the user to carry these items securely and preferably releasably on the garment. The slot passage may also include fastening mechanisms, such as draw stings or tie downs, to more snugly secure the items within the slot. Although the slot passage and pouch opening pocket configuration have only been described herein with respect to the upper back pocket 55, those of ordinary skill in the art can readily determine which configurations can be adapted for use with other pockets on the posterior portion 30 according to the invention described herein.

In another embodiment, the garment can include a personal hydration system. For example, the system can include a container, or a pocket for holding a container, that is associated with a dispensing member, such as a flexible tube or hose. In a preferred embodiment, the personal hydration system includes a bottle or other sealable container that is removeably, yet securely, held in a pocket on the posterior portion 30. The pocket is preferably made of an elastic, mesh material. The bottle is configured for sealably containing a liquid therein, such as water or an energy drink, and includes a tube that is adapted and configured to extend to an area on the anterior portion 20 adjacent the user's mouth. For example, the tube can extend along the side of the garment and up the exterior surface of the anterior portion 20, or it can extend up the exterior surface of the posterior portion 30 and over either of the shoulder portions. Preferably, the tube is maintained adjacent to, or along the surface of, the garment as it extends from the bottle to the anterior side. More preferably, the garment includes sufficient fasteners, loops, snaps, or the like to maintain the tube adjacent to and/or along and in contact with the surface.

In another preferred embodiment, the container of the personal hydration system can be a pocket on the posterior portion 30, the pocket configured for sealably containing a liquid therein. The system also includes a tube that is sealably connected to the pocket, and the tube is preferably configured to extend to an area on the anterior portion 20 adjacent the user's mouth. Preferably, the tube extends along the exterior surface of the garment, as previously described, but the tube can also connect to the interior side of the pocket and extend along the interior surface of the garment toward the area adjacent the user's mouth.

The preferred embodiments previously described are for exemplary purposes only, and those of ordinary skill in the art can readily determine other suitable configurations where the anterior portion 20 and posterior portion 30 can include on their surfaces any additional combination of pockets with suitable locations, dimensions, and fastening portions described herein, based on the guidance of the description herein. For example, but not intended to limit the invention, the preferred embodiment of FIG. 1 depicts three pockets that decrease in size in a direction from the medial edge to the distal edge of the anterior portion, however, any or all of these pockets can have the same height or decrease in size in the opposite direction if desired. Also, any or all of the additional pockets on the anterior or posterior portions (in addition to the one each on the anterior and posterior portions) can be releasably detachable by the fasteners described herein for removal if not necessary to carry additional cargo within the garment apparatus. The pockets described herein can also include smaller pockets within the pockets of the anterior and posterior portions, the smaller pockets preferably configured and dimensioned for securely storing smaller-sized gadgets and items rather than having such items loosely contained within the larger pockets. Such smaller pockets can also have one or more exit ports as described above.

The garment apparatus can be constructed in different sizes to fit different users, e.g., small, medium, large, and extra-large men, women or children, and the pockets (aside from, e.g., the cell phone pocket) can be commensurately larger or smaller depending on the available space on the apparatus. Further, the apparatus is preferably made of a water-resistant or water-proof, light-weight fabric to minimize or prevent overheating of the user while wearing the apparatus. Preferably, the apparatus comprises a synthetic polymer, more preferably a nylon or neoprene containing material. In other embodiments, the apparatus can include water-resistant or water-proof materials of heavier weight or thickness to help the user retain additional warmth for colder climate usage. The apparatus can also include removable sleeves and hood for use in colder conditions, although a hood is not as preferred because when present but not worn it would tend to block the anterior upper pocket(s). Portions of the apparatus, for example, one or more of the collar, shoulder portions, side portions, and cell phone pocket or other pocket(s), can be made of a mesh material to increase ventilation for the user or the pocket contents, however, this precludes water-resistance or water-proofing at that location. In other embodiments, the apparatus, or portions thereof, is preferably made of a fire-resistant or fire-proof material, either light-weight or heavy-weight, that prevents or substantially reduces burning of the user while wearing the apparatus upon exposure to flames or extreme heat. Preferably, the apparatus is made of a material that is both water-resistant or water-proof, and fire-resistant or fire-proof, or is made of multiple layers of material, each material having one of these properties.

In some embodiments, the exterior pockets are made of a mesh material, such that the contents within the pockets are at least partially visible from the exterior through the mesh material. Preferably, the mesh material is flexible. In alternative embodiments, the exterior of the pockets can be made of a material that is preferably rigid and clear, opaque, or translucent to also provide a "see-through" characteristic to the pockets. For example, the exterior of the pockets can be made of a substantially clear plastic material.

Additionally, some portions of the apparatus can include resilient sections that are made of flexible and resilient material, for example nylon and materials with similar elastic characteristics. Preferably, there are one or two resilient sections to join the anterior and posterior portions on the left or right sides, or both. The resilient section can include an anterior edge and a posterior edge, the anterior edge being joined to the anterior portion and the posterior edge being joined to the posterior portion. In some embodiments, the resilient sections are located proximate the side attachments and/or shoulder portions. In other embodiments, substantially the entire apparatus includes resilient sections. Resilient sections comprising resilient material preferably provide a snug fit when worn by the user. "Snug fit" can advantageously ergonomically distribute weight or cargo retained in the pockets of the garment apparatus, and the term is intended to refer to the garment apparatus conforming to the body of a user, typically where there is some tension on a portion of the resilient section(s) as this is expected to stretch in any necessary locations to facilitate conformation of the garment apparatus to the user.

The garment apparatus can also include reflective material disposed in one or more locations about the external surfaces of the anterior and posterior portions. In one embodiment, the entire garment is made of a reflective material. In other embodiments, the garment includes reflective material disposed on a portion of the trim, on one or more fastening mechanisms, or on one or more patches disposed on select areas of the garment's surfaces, for example, patch 70 disposed on the posterior surface of the garment as shown in FIG. 3. Such reflective materials are preferably arranged and configured so as to increase the visibility of the wearer and the garment apparatus.

The term "about," as used herein, should generally be understood to refer to both the corresponding number and a range of numbers. Moreover, all numerical ranges herein should be understood to include each whole integer within the range.

While illustrative embodiments of the invention are disclosed herein, it will be appreciated that numerous modifications and other embodiments can be devised by those of ordinary skill in the art. Features of the embodiments described herein can be combined, separated, interchanged, and/or rearranged to generate other embodiments. Therefore, it will be understood that the appended claims are intended to cover all such modifications and embodiments that come within the spirit and scope of the present invention.

What is claimed is:

1. A backpack garment for carrying useable items distributed about the torso, comprising:

a vest having a back side, and a front side, the front side being divided generally into a separate left half portion and a separate right half portion so as to permit a wearer to don the vest and subsequently remove the vest, the left and right halves each having a front edge and a side edge and the left and right halves being joinable together at their respective front edges by a fastener, the back and front sides each comprising a top and a bottom, the back side being joined respectively to each of the front left and right sides at their respective tops;

the vest further comprising left and right side arm openings;

the garment further comprising a plurality of pockets including a first double pocket comprising a large pocket fixedly attached to the vest and a smaller pocket attached to the outside surface of the large pocket and a covering flap hingedly attached to the vest and extending over both the large and small pockets of the first double pocket and a second double pocket fixedly attached to the vest such that the second double pocket spans substantially from across the back side of the vest between about the right arm opening to about the left arm opening, the second double pocket comprising a first pocket attached to the vest and a second pocket attached to the first pocket of the second double pocket, the first and second pockets of the second double pocket having individual closure means thereon closing the first and second pockets of the second double pocket individually.

2. The backpack garment of claim 1, further comprising at least one shoulder pad attached to the interior side of the top of the garment, at least one cushioning material in at least one pocket or between a pocket and the interior of the vest, at least one interior lining associated with the garment, or a combination thereof.

3. The backpack garment of claim 1, further comprising a releasable fastener to releasably fasten at least one of the pockets or an internal port for providing a passage from the inside of a pocket to the inside of the garment, or both.

4. The backpack garment of claim 3, wherein the releasable fastener comprises at least one of a zipper, snap, button, clip, hook and loop fastener, tie, and drawstring.

5. The backpack garment of claim 1, wherein the at least one pocket fixedly attached to the back side of the vest is located substantially proximal to the top of the garment.

6. The backpack garment of claim 1, wherein the second double pocket is located predominantly in a lower half of the posterior portion.

7. The backpack garment of claim 1, wherein one of the pockets on the front side of the vest is a cell phone pocket configured and dimensioned so as to receive and substantially conform to a cell phone when disposed therein.

8. The backpack garment of claim 1, wherein one of the pockets on the back side of the vest is adapted and configured to define a pouch opening or slot passage for releasably holding at least one item therein or placing at least one item therethrough.

9. The backpack garment of claim 8, wherein the pouch opening is configured for storing at least one item between the pocket and the back side of the vest.

10. The backpack garment of claim 8, wherein the pocket is attached to the back side of the vest along two sides so as to leave at least a portion of each of the remaining two sides open to define the slot passage between the pocket and the back side of the vest for placing one or more items therethrough.

11. The backpack garment of claim 1, further comprising an electronic control unit disposed on, or integrally associated within, an exterior surface of the garment.

12. The backpack garment of claim 11, wherein the electronic control unit is configured and adapted to be operatively associated with a hardwired and/or wireless electronic device contained within one of the pockets of the garment.

13. The backpack garment of claim 1, further comprising a personal hydration system which comprises a container fixedly or releasably attached to the garment or a portion thereof, or a pocket for releasably holding a container, which container is associated with a dispensing member and which is adapted to hold a consumable beverage.

14. The backpack garment of claim 1, further comprising a fastening device configured and adapted to removably fasten the pockets to the garment.

15. The backpack garment of claim 1, wherein the total pocket volume available on the front side of the vest is sufficient to counterbalance the total pocket volume available on the back side of the vest.

16. The backpack garment of claim 1, wherein the fastener joining the front edges of the left and right halves of the vest comprises at least one of a snap, button, zipper, hook and loop fastener, adjustable belt portion, or tie.

* * * * *